United States Patent [19]

Coynel et al.

[11] 4,404,443

[45] Sep. 13, 1983

[54] ELECTROMAGNETIC RELAY

[75] Inventors: Daniel Coynel; Maurice Roussigne, both of Paris, France

[73] Assignee: Thomson-CSF, Paris, France

[21] Appl. No.: 308,170

[22] Filed: Oct. 2, 1981

[30] Foreign Application Priority Data

Oct. 3, 1980 [FR] France ..... 80 21224

[51] Int. Cl.[3] ..... H01H 33/18

[52] U.S. Cl. ..... 200/147 A

[58] Field of Search ..... 200/147 A

[56] References Cited

U.S. PATENT DOCUMENTS

| | | | |
|---|---|---|---|
| 2,411,892 | 12/1946 | Peters | 200/147 A |
| 2,506,991 | 5/1950 | Brown | 200/147 A |
| 3,024,334 | 3/1962 | Rhodes . | |
| 3,090,854 | 5/1963 | Kretzschmar | 200/147 A |
| 3,092,700 | 6/1963 | Cohen . | |
| 3,319,200 | 5/1967 | Witzler . | |
| 3,384,772 | 5/1968 | Rabinowitz | 200/147 A |

FOREIGN PATENT DOCUMENTS

| | | |
|---|---|---|
| 715615 | 1/1942 | Fed. Rep. of Germany . |
| 2729473 | 1/1979 | Fed. Rep. of Germany . |
| 2756686 | 6/1979 | Fed. Rep. of Germany . |
| 758782 | 10/1956 | United Kingdom . |

OTHER PUBLICATIONS

*Primary Examiner*—Robert S. Macon

*Attorney, Agent, or Firm*—Oblon, Fisher, Spivak, McClelland & Maier

[57] ABSTRACT

An improved relay for increasing the service life of contacts and the breaking capacity. Each fixed contact is mounted on a solid parallelepipedal block having a hollowed-out portion for receiving the end of the corresponding connection rod and providing a high-quality connection by brazing. The relay is further provided with means for extinguishing the electric arc by lengthening the arc, a permanent magnet being accordingly employed for each pair of associated contacts, one contact being fixed and the other being movable. The magnet is preferably housed within a spark trap.

8 Claims, 10 Drawing Figures

ELECTROMAGNETIC RELAY

This invention relates to electromagnetic relays and is primarily directed to relays having a breaking capacity for medium and high current values within the range, for example, of 5 to 50 amps approximately. The invention is advantageously applicable to the construction of relays of this type in a miniaturized form.

It can be considered that a relay is composed of two main elements, namely an actuating or motor element which carries and actuates movable contacts, and a base element which supports fixed contacts. Each fixed contact is associated with one end of a movable strip; this end portion constitutes a movable contact which bears on the associated fixed contact either in the rest position or in the operating position as the case may be. The fixed contact is usually crimped or welded on a rigid support of small thickness in the form of a right-angle bracket which is rigidly fixed to a lead-out rod by electric welding, said rod being adapted to traverse the base through a glass-metal seal. The other end of the rod located externally of the relay constitutes a terminal connector-pin.

At the time of operation of the relay, an electric arc is established between the fixed contact and the corresponding movable contact actuated by the motor element in the direction of either closing or opening. This phenomenon causes erosion of the contacts and consequently gives rise to vaporizations of metal by reason of the high thermal impedance exhibited by the contacts. The welded joint between the support bracket and the rod as well as the joint formed by crimping the contact on the bracket constitute constrictions which have the effect of preventing rapid heat removal, thus producing a temperature build-up under arc discharge conditions. In order to ensure that contacts have a sufficiently long service life, it is consequently necessary to increase the switching speed in order to limit the arcing time as far as possible and it also proves necessary to limit the breaking capacity of the relay.

The aim of the invention is to overcome the disadvantages caused by electric arcs and to permit an increase in the breaking capacity of the relay while retaining if not actually improving the characteristics of this latter, especially from the point of view of reliability and length of service life.

One object of the invention is to improve the fixed contacts in order to enable them to absorb the heat energy produced by electric arcs under conditions of flow of a high current, each fixed contact being formed by means of a solid metal block pierced by a hole for receiving and welding the end of the corresponding rod to said block.

This arrangement offers the advantage of reduction in thermal impedance of the fixed contacts, thus permitting rapid heat removal by means of high-quality connections which eliminate all constrictions or throttled portions in relay assemblies of the prior art mentioned in the foregoing.

A further object of the invention is to provide the relay with a complementary feature in the form of electric arc-extinguishing means which serve to lengthen the arc and to minimize its harmful effects.

In respect of a given flow of current, an electric arc is interrupted when its length attains a certain value. Premature extinction of the electric arc is made possible by lengthening this latter in accordance with various techniques applied to power circuit-breakers used in electric power distribution systems. One pneumatic design makes use of compressed-air blowout. Another design solution of the magnetic type involves the creation of a magnetic field in a plane at right angles to the electric current which passes along the arc. The magnetic induction field gives rise to a Laplacian force which has the effect of lengthening the electric arc. The magnetic induction field is produced by means of a coil traversed by the high current which flows between the contacts, said coil being correctly positioned with respect to said contacts. This coil design cannot be transposed to an electromagnetic relay of small size, in the first place by reason of the excessively low value of the current which passes through the coil, especially within the range of 5 to 50 amps and in the second place by reason of the fact that permissible overall dimensions are limited.

In accordance with the invention, the relay is provided with arc-extinguishing means constituted by one or a number of permanent magnets which form a unit of small overall size.

The advantages thereby achieved are as follows: reduction in erosion of contacts and vaporizations of metal, reduction in heat energy to be dissipated and in local heat build-up, increase in breaking capacity, and reduction in power consumption in respect of an equivalent breaking capacity.

These and other features of the invention will be more apparent upon consideration of the following description and accompanying drawings, wherein.

Figure 1:
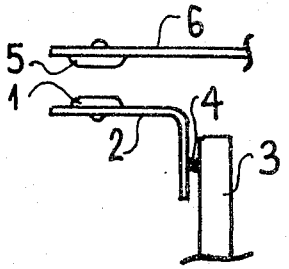
FIG. 1 is a diagram showing a conventional assembly of a fixed contact in accordance with the prior art.

FIG. 1 recalls the prior art assembly in which a fixed contact 1 is crimped on a right-angled member 2 supported by a lead-out rod 3 by means of a welded joint 4. The associated movable contact is constituted by a contact 5 crimped on the end of a movable contact 6 actuated by the relay motor.

Figure 2:
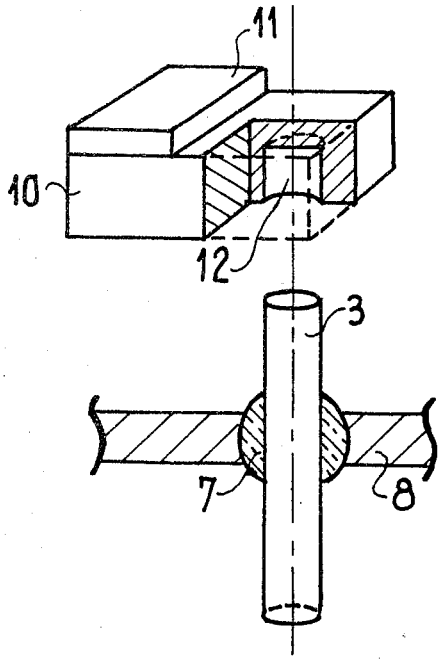
FIG. 2 is a perspective view of one embodiment of a fixed contact in accordance with the invention.

FIG. 2 illustrates a fixed contact which is arranged in accordance with the present invention. The contact comprises a solid metal block 10 of parallelepipedal shape, for example, and corresponding to the support member. On one face of said block, the added element 11 constitutes the contact proper and this latter is made of material which is different from the support block 10. Said block is provided with a hollowed-out portion 12 of suitable shape and size to receive the corresponding end of the connection rod 3. Said rod is shown with the glass-metal through-bushing 7 formed in the base 8 of the relay. The rod 3 is welded to the support block 10 in the hollowed-out portion 12 in order to ensure a high-quality connection between these two elements, both from a thermal and electrical standpoint. The contact 11 is also of parallelepipedal shape and of smaller size than the support block 10, with the result that its position is located off-center with respect to the sealing passage or through-bushing 7 provided for the rod 3.

Figure 3:
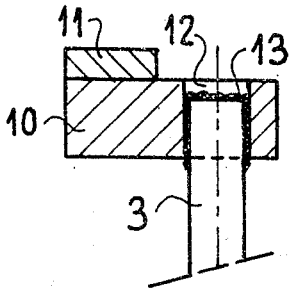
FIG. 3 shows a preferential embodiment of a fixed contact in accordance with the invention.

As shown in FIG. 3, the hollowed-out portion 12 is preferably constituted by a bore which extends throughout the thickness of the block 10 in order to facilitate the formation of a brazed joint 13 having a high capacity for wetting the materials present. The support block 10 is made of material having good thermal and electrical conductivity such as a copper alloy. In addition, the fixed contact 11 must exhibit anti-wear characteristics and can be formed of a silver-base alloy deposited on one face of the block 10 in accordance with any suitable technique such as welding, for example. The assembly 10-11 can thus be formed by bilaminating. The parallelepipedal shape of the solid contact 10–11 is readily adapted to filling of the available volume and permits effective cooling of the contact zone, taking into account the distances of insulation and fixing at the through-passage location.

Figure 4:
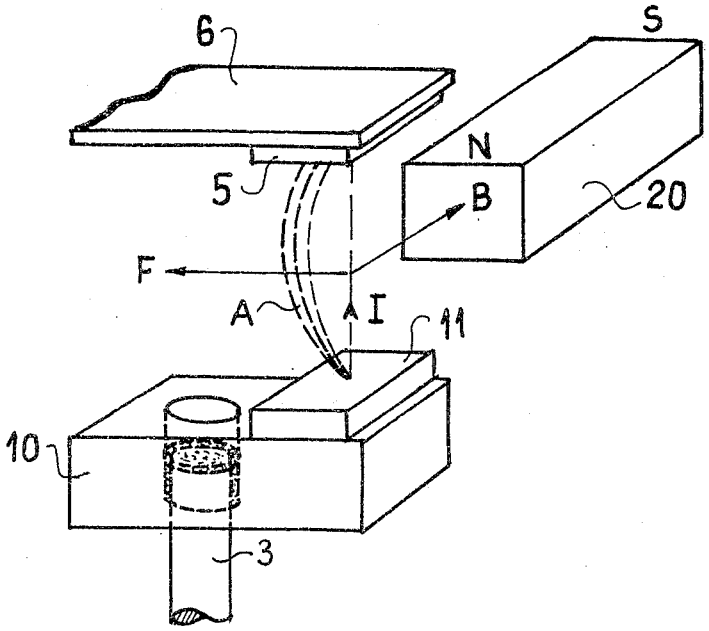
FIG. 4 is a diagram illustrating the phenomenon of lengthening of the electric arc by magnetic action in a relay in accordance with the invention.

The following FIGS. 4 to 11 relate to the arrangement of the relay with means for extinguishing the electric arc by producing a magnetic field. FIG. 4 shows the direction of the current I which flows between the pair of associated contacts, namely the fixed contact 11 and the movable contact. The presence of a magnetic field represented by the induction vector B having a direction at right angles to that of the current gives rise to a Laplacian force F which has the direction indicated and causes lengthening of the arc A. The magnetic field is produced by means of a permanent magnet 20 of small size. This design solution, which is advantageous from the point of view of overall size as well as efficiency and power consumption, can advantageously be employed for miniature electromagnetic relays.

Figure 5:
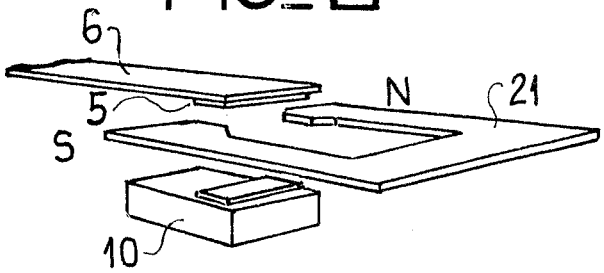
FIG. 5 to 9 show different embodiments of the arc-extinguishing means employed in FIG. 4.
Figure 6:
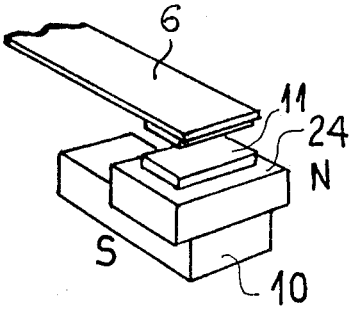
Figure 7:
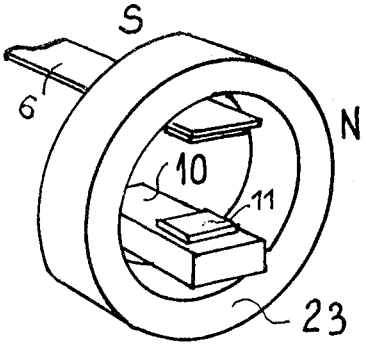
Figure 8:
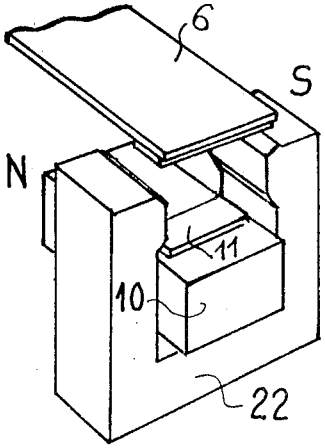

FIGS. 5 to 9 show different embodiments. The magnet placed in proximity to a pair of contacts can be of horseshoe shape (as shown in FIG. 5 or FIG. 8) or of circular shape (as shown in FIG. 7). The fixed contact 10-11 shown in these figures is of the solid type described earlier but is not intended to imply any limitation.

Figure 9:
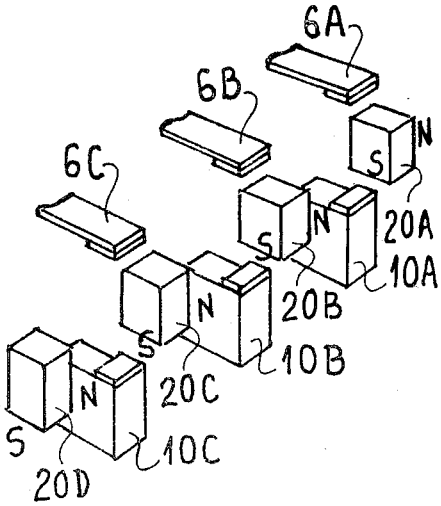

In FIG. 6, the contact 11 is of larger size in order to receive a magnet 24 of recessed shape. The case of FIG. 9 illustrates one example of a configuration comprising a plurality of fixed contacts 10A, 10B and 10C in side-by-side relation and a plurality of permanent magnets 20A, 20B, 20C and 20D arranged laterally at each end and within the intervals between adjacent contacts.

Figure 10:
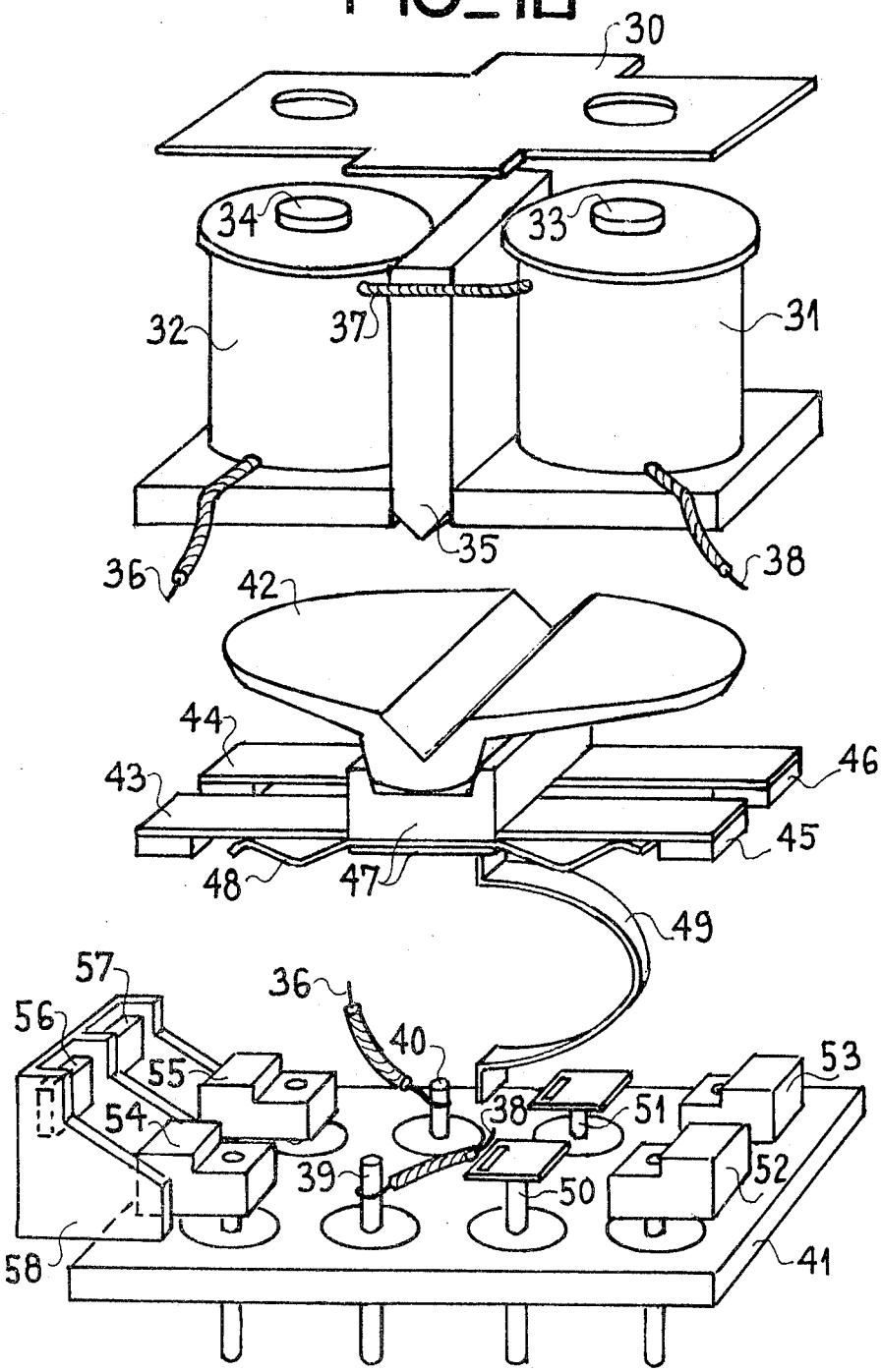
FIG. 10 is an exploded view of a miniature polarized electromagnetic relay endowed with the improvements in accordance with the invention.

FIG. 10 corresponds to one application of the invention to a miniature polarized electromagnetic relay. The actuating unit at the top portion comprises the following elements: a yoke 30, two coils 31 and 32, the plunger cores 33 and 34 which form the magnetic circuit of the coils together with the yoke 30, a magnet 35, the electrical connections 36, 37, 38 which serve to energize the coils and are connected to terminal connector-pins 39 and 40 of the base 41, the armature 42, two movable strips 43 and 44 adapted to carry contacts such as 45 and 46 at each end, insulating members 47, two backing strips such as the strip 48 shown in the figure and two spring linkages including the linkage 49 shown in the figure, the design function of said linkages being to provide an electrical connection between the contact-strips and the corresponding terminal connector-pins 50 and 51 of the base, thus providing a so-called common-point connection. Four solid fixed contacts 52, 53, 54 and 55 are shown on the base of the relay. The means for extinguishing the electric arc are constituted by magnets 56, 57 housed within a spark trap 58 of insulating material interposed between the housing (not shown) and the contacts; a similar configuration (not illustrated for the sake of enhanced simplicity) is provided on the side corresponding to the fixed contacts 52 and 53.

An electromagnetic relay endowed with the improvements described in the foregoing provides a longer contact lifetime under high current conditions. This in turn results in an improvement in the characteristics of the relay, particularly in regard to breaking capacity, length of service life and reliability. By way of indication but not in any sense by way of limitation, the practical application of the techniques set forth in the foregoing to a miniature relay of one cubic half-inch readily permits a breaking capacity of approximately ten amps.

What is claimed is:

1. An electromagnetic relay comprising:

a base traversed by connection rods;

at least one fixed contact supported by a metallic member welded to one end of a connection rod, said fixed-contact support member being designed in the form of a solid block provided with a hollowed-out portion for receiving the end of the corresponding connection rod;

at least one strip subjected to an actuating element, the fixed contact being operatively associated with a corresponding contact located at one end of the movable strip;

means for extinguishing the electric arc by lengthening said arc, said means being provided in the case of each pair of associated contacts in which one contact is fixed and the other contact is movable with at least one permanent magnet for producing a magnetic field in a direction at right angles to the direction of the current which flows between said associated contacts.

2. A relay according to claim 1, wherein the support block is of parallelepipedal shape as well as the fixed contact which is of smaller size and applied against one face of the support block.

3. A relay according to claim 2, wherein the hollowed-out portion extends through the support block which is rigidly fixed to the connection rod by brazing.

4. A relay according to claim 2 or claim 3, wherein the assembly consisting of support block and fixed contact is produced by bilamination.

5. A relay according to claim 1 or claim 2, wherein the magnet is housed within a spark trap.

6. A relay according to claim 5, wherein the magnet is of parallelepipedal shape.

7. A relay according to claim 5, wherein the magnet has a horseshoe shape.

8. A relay according to claim 5, wherein the magnet is of circular shape.

* * * * *